US009512651B2

(12) United States Patent
Taurasi et al.

(10) Patent No.: US 9,512,651 B2
(45) Date of Patent: Dec. 6, 2016

(54) DOUBLE RATCHET, DOUBLE PAWL VEHICULAR LATCH WITH SOFT STOP ON RESET

(75) Inventors: Marco Taurasi, Leghorn (IT); Francesco Cumbo, Pisa (IT)

(73) Assignee: Magna Closures S.p.A., Guasticce (Livorno) (IT)

( * ) Notice: Subject to any disclaimer, the term of this patent is extended or adjusted under 35 U.S.C. 154(b) by 246 days.

(21) Appl. No.: 14/122,818

(22) PCT Filed: May 25, 2012

(86) PCT No.: PCT/EP2012/002238
§ 371 (c)(1),
(2), (4) Date: Nov. 27, 2013

(87) PCT Pub. No.: WO2012/163503
PCT Pub. Date: Dec. 6, 2012

(65) Prior Publication Data

US 2014/0091581 A1 Apr. 3, 2014

Related U.S. Application Data

(60) Provisional application No. 61/490,875, filed on May 27, 2011.

(51) Int. Cl.

| | |
|---|---|
| ***E05C 3/06*** | (2006.01) |
| ***E05B 81/42*** | (2014.01) |
| ***E05B 77/36*** | (2014.01) |
| ***E05B 81/06*** | (2014.01) |
| ***E05B 81/14*** | (2014.01) |
| ***E05B 81/34*** | (2014.01) |

(Continued)

(52) U.S. Cl.
CPC ..... *E05B 81/42* (2013.01); *E05B 77/36* (2013.01); *E05B 81/06* (2013.01); *E05B 81/14* (2013.01); *E05B 81/34* (2013.01); *E05B 15/04* (2013.01); *Y10T 292/1046* (2015.04)

(58) Field of Classification Search
CPC ..... E05B 81/06; E05B 81/14; E05B 81/15; E05B 81/16; E05B 81/30; E05B 81/34; E05B 81/42; E05B 81/50; E05B 77/36; E05B 15/04
USPC ..... 292/201, 216, 199, 200, 198, 194,292/DIG. 23, 97, 99, 100, 196
See application file for complete search history.

(56) References Cited

U.S. PATENT DOCUMENTS

2004/0055407 A1* 3/2004 Coleman ..... E05B 81/20 74/425
2008/0073917 A1* 3/2008 Ciavaglia ..... E05B 81/20 292/201

(Continued)

FOREIGN PATENT DOCUMENTS

WO WO 2009/143997 A 12/2009
WO WO 2011/094834 A1 8/2011

*Primary Examiner* — Alyson M Merlino
(74) *Attorney, Agent, or Firm* — Dickinson Wright

(57) ABSTRACT

A low release effort eccentric double ratchet, double pawl vehicle latch includes a ratchet, a primary pawl, an auxiliary ratchet and a secondary pawl. A drive mechanism including a gear cam wheel sequences movement of the secondary pawl to open and reset the latch. Upon reset, the drive mechanism actuates the auxiliary ratchet back to a closed state in a soft manner without using a hard stop; instead the latch has a cushioning spring that is used to softly stop the gear train during the reset absorbing motor energy and thus eliminating impact noise.

23 Claims, 12 Drawing Sheets

(51) Int. Cl.
*E05C 3/16* (2006.01)
*E05B 15/04* (2006.01)

(56) References Cited

U.S. PATENT DOCUMENTS

| | | | | |
|---|---|---|---|---|
| 2008/0224482 | A1* | 9/2008 | Cumbo | E05B 77/02 292/216 |
| 2010/0052341 | A1* | 3/2010 | Taurasi | E05B 81/14 292/304 |
| 2010/0127511 | A1* | 5/2010 | Vasquez | E05B 81/06 292/201 |
| 2011/0204673 | A1* | 8/2011 | Cumbo | E05B 81/06 296/146.1 |

* cited by examiner

DOUBLE RATCHET, DOUBLE PAWL VEHICULAR LATCH WITH SOFT STOP ON RESET

CROSS-REFERENCE TO RELATED APPLICATIONS

This application claims the benefit of U.S. Provisional Patent Application No. 61/490,875, filed May 27, 2011 and International Application PCT/EP2012/002238, filed May 25, 2012, the disclosures of which are incorporated fully herein by reference.

FIELD OF THE INVENTION

The invention generally relates to the art of vehicular latches and more specifically to vehicular latches that utilize double ratchet, double pawl arrangements.

BACKGROUND OF THE INVENTION

Double ratchet, double pawl arrangements are known in the latching art. The double ratchet, double pawl arrangement may utilize a first pawl and ratchet set connected to a second pawl and ratchet. The connection may be configured such that only a portion of the forces experienced by the first pawl and ratchet set are applied to the second pawl and ratchet set, thus requiring only a relatively low effort to release the latch. Such latches are also known as eccentric latches. An example of such an eccentric latch is described in WO 2011/094834A1 published Aug. 11, 2011 and entitled "Vehicular Latch with Double Pawl Arrangement", the contents of which are incorporated by reference herein.

In a double ratchet, double pawl arrangement the secondary pawl and secondary ratchet are reset back to their initial positions by an electromechanical actuator. Unfortunately, this can be a rather noisy proposition since the actuator that carries out the reset operation encounters a hard stop. The noisiness of the reset operation is particularly accentuated to the user because at this point the vehicle door is open and so the noise of the gear train is not masked by the opening of the door itself. The invention seeks to provide a less noisy reset operation.

SUMMARY OF THE INVENTION

According to one aspect of the invention a vehicle latch is provided which includes a ratchet, a primary pawl, an auxiliary ratchet and a secondary pawl. The ratchet is movable between a striker release position wherein the ratchet is positioned to receive a striker and a striker capture position wherein the ratchet is positioned to retain the striker, the ratchet being biased towards the striker release position. The primary pawl is movable between a ratchet checking position wherein the primary pawl is positioned to keep the ratchet in the striker capture position and a ratchet release position wherein the primary pawl permits the movement of the ratchet out of the striker capture position, the primary pawl being biased towards the ratchet checking position. The auxiliary ratchet is operatively connected to the primary pawl, the auxiliary ratchet being movable between an enabling position in which the primary pawl is enabled to move to the ratchet checking position and a disabling position in which the auxiliary ratchet positions the primary pawl to the ratchet release position. The secondary pawl is movable between an auxiliary ratchet holding position, in which the secondary pawl is positioned to hold the auxiliary ratchet in the enabling position, and an auxiliary ratchet release position, in which the secondary pawl is positioned to permit movement of the auxiliary ratchet to the disabling position, the secondary pawl being biased to the auxiliary ratchet holding position.

The latch includes a drive mechanism having a motor driving a cam via a gear set. The cam is operatively connected to the auxiliary ratchet and the secondary pawl. The cam moves in a first direction in order to open the latch by actuating the secondary pawl into the auxiliary ratchet release position, the auxiliary ratchet thereafter moving to the disabling position. The cam also moves in a second direction in order to reset the latch by actuating the auxiliary ratchet into the enabling position, the secondary pawl thereafter moving to the auxiliary ratchet holding position. After actuating the auxiliary ratchet into the enabling position, the cam continues to travel in the second direction to load an elastic member, which decelerates the cam.

The latch may include a controller and means for signaling the controller when the cam loads the elastic member, the controller being operative to switch off power to the motor in response to the signaling means.

The auxiliary ratchet may be biased to the disabling position. The cam, when moving in the first direction, also actuates the auxiliary ratchet to the disabling position in the event the auxiliary ratchet does not enter the disabling position upon movement of the secondary pawl out of the auxiliary ratchet holding position, whereby the primary pawl is moved into the ratchet release position.

A reset lever may be operatively connected between the cam and the auxiliary ratchet. When moving in the first direction, the cam actuates the reset lever which in turn actuates the auxiliary ratchet in the event the auxiliary ratchet has not yet entered into the disabling position. When moving in the second direction, the cam actuates the reset lever which in turn actuates the auxiliary ratchet.

In an embodiment the auxiliary ratchet has a projection and the reset lever has a fork with two spaced apart first and second prongs straddling the projection. The reset lever is biased to an initial position where the first prong is proximate the projection and the second prong is distal the projection. In operation, as the cam moves in the first direction to actuate the reset lever the first prong moves the projection. As the cam begins to move in the second direction, opposite the first direction, the reset lever returns to the initial bias position such that the second prong is proximate the projection and the first prong is distal the projection. And as the cam continues to move in the second direction to actuate the reset lever, the second prong moves the projection. In an embodiment the cam is a gear wheel having a discus and a circumference; gear teeth are disposed along the circumference; a first push block is disposed on the discus for engaging the secondary pawl; a second push block is disposed on the discus for engaging the reset lever in the first direction of motion; and an arcuate push block is disposed on the discus for engaging the reset lever in the second direction of motion, the arcuate push block having a post therein for loading the elastic member.

In an embodiment, the primary pawl is pivotally mounted to the auxiliary ratchet. The auxiliary pawl is pivotal about a first axis, and the primary pawl may be pivotally mounted to the auxiliary pawl about a second axis that is offset from the first axis. This provides the eccentric arrangement whereby seal force of the closed vehicle door is applied to the auxiliary ratchet.

In an embodiment means are provided for manually actuating the secondary pawl to the auxiliary ratchet release position. A manually actuated emergency release lever having a first limb for engaging the auxiliary ratchet and a second limb for engaging the primary pawl may also be provided. The emergency release lever may be actuated by a door handle.

From the foregoing it will be seen that an electrical actuator to release the latch when the actuator is activated in one direction may be provided in an embodiment. The same actuator will reset the latch once it is powered in the opposite direction. In an embodiment, the latch has been equipped with a "coupling/decoupling" cam. In the coupling position the cam release and reset the latch, and in the decoupling position, the cam will allow the release/reset gear chain to go into an "over-travel" condition eliminating a hard stop during the reset operation. The elastic member, which may be a cushioning spring, is used to softly stop the gear chain during reset, absorbing the motor energy and eliminating impact noise. In an embodiment a sensor on the cam is provided, which is used to switch off the motor before the cam reaches its full travel. The motor is then in short circuit acting as a brake decelerating the gear chain and preventing full travel impact noise.

BRIEF DESCRIPTION OF THE DRAWINGS

The foregoing and other aspects of the invention will be more readily appreciated having reference to the drawings, wherein.

DETAILED DESCRIPTION OF EMBODIMENTS OF THE INVENTION

Figure 1A:
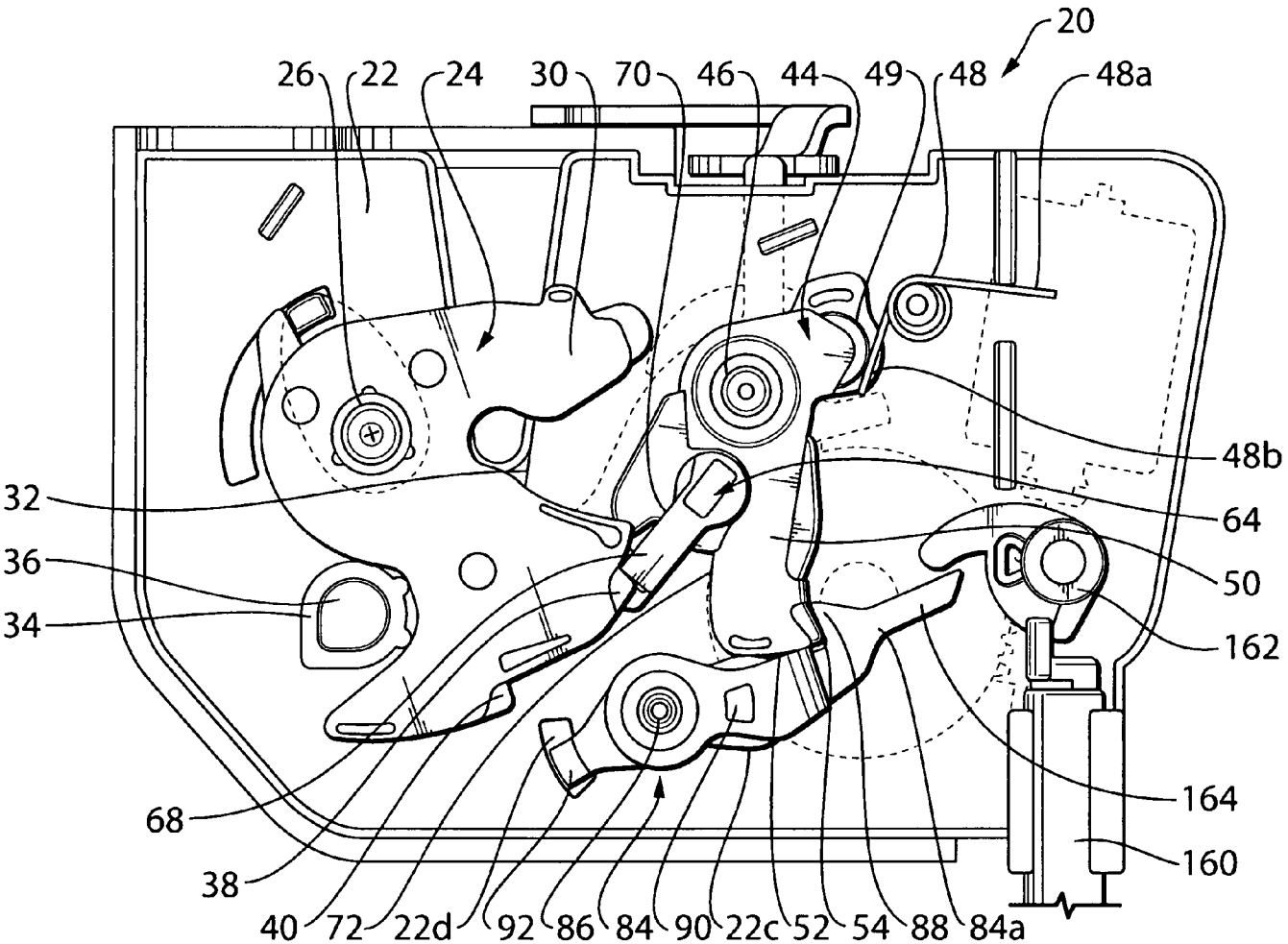
FIG. 1A is a front view of a latch with a front cover removed from view.

FIG. 1A is a front view of an electric latch 20 that includes a housing 22 in which a ratchet 24 is pivotally mounted for rotation about a pin 26 mounted in the housing 22. The ratchet 24 pivots between a fully closed position (which may also be referred to as the striker capture position) as shown in FIG. 1A wherein a striker (not shown) is captured by a hook 30 (which may also be referred to as the claw 30) of the ratchet 24, and an open position (which may also be referred to as the striker release position) wherein the striker is not trapped by the hook 30 and free to move out of the slot presented by the hook 30. In the orientation shown in FIG. 1A the ratchet 24 will rotate counterclockwise to move into the open or striker release position.

Figure 1B:
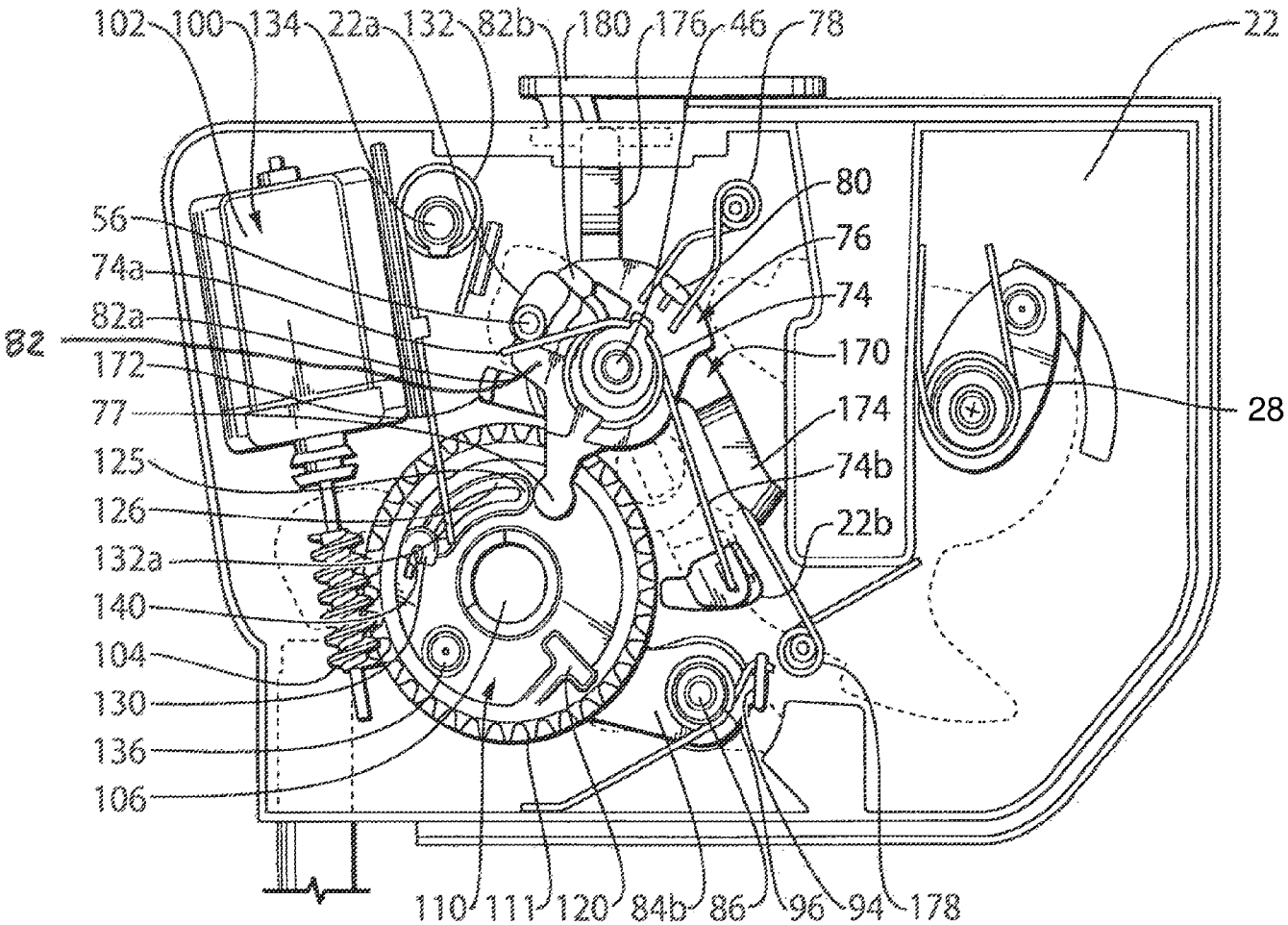
FIG. 1B is a rear view of the latch with a rear cover removed from view.

The ratchet 24 is biased to the open position via a biasing spring 28 (see FIG. 1B). A striker bumper 32 is mounted in the housing 22 (underneath the ratchet 24) to cushion against the striker force of impact and a ratchet bumper 34 is also mounted about a post 36 presented in the housing 22 to cushion against the ratchet force of impact.

An auxiliary ratchet 44, which may be alternatively referred to as a cam, is also pivotally mounted in the housing 22 about a post 46. The auxiliary ratchet 44 includes a bore for pivotally mounting a primary pawl 64 therein. As discussed in greater detail below the auxiliary ratchet 44 pivots between a closed position (which may also be referred to as the enabling position) where the primary pawl 64 is enabled to inhibit rotation of the ratchet 24, and an open position (which may also be referred to as the disabling position) where the primary pawl 64 is disabled from inhibiting rotation of the ratchet. In the orientation shown in FIG. 1A the auxiliary ratchet 44 will rotate counterclockwise to enter the open position.

A spring 48 biases the auxiliary ratchet 44 to the open position. The spring 48 has a first tang 48*a* abutting the housing 22 and a second tang 48*b* abutting a shoulder 49 of the auxiliary ratchet 44

The auxiliary ratchet 44 also includes a leg 50 which terminates in a cushioning surface 52 and a check shoulder 54.

Figure 4:
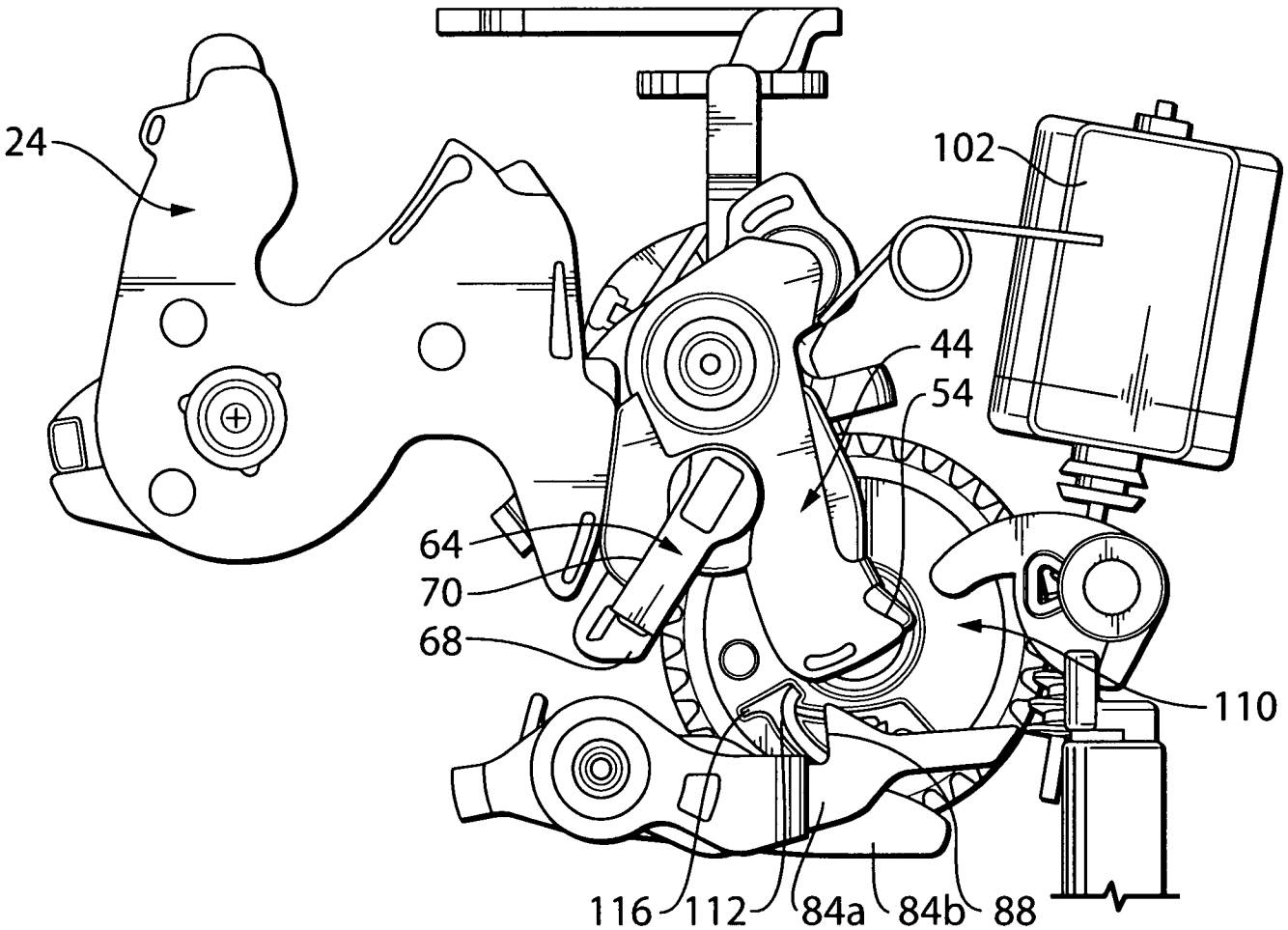
FIG. 4 is a partial front elevation view of the latch in a partially actuated state of opening the latch.

The primary pawl 64 features a check arm 68 which pivots on the auxiliary ratchet 44 and thus may be moved by the auxiliary ratchet 44. The check arm 68 moves between a closed position (which may also be referred to as a ratchet checking position) in which the check arm 68 prevents opening of the ratchet 24, as shown in FIG. 1A, and an open position (which may also be referred to as the ratchet release position), as shown in FIG. 4, in which the check arm 68 permits rotation of the ratchet 24 to the open position. In the orientation of FIG. 1A the primary pawl 64 will rotate counterclockwise to move into the open position. The check arm 68 sweeps an angle within a V-shaped cutout in the auxiliary ratchet 44 that is delimited on either side by edges 70, 72.

Referring additionally to the rear or opposing view of FIG. 1B, the primary pawl 64 may be biased to the closed or ratchet checking position by a spring 74 wrapped around post 46. The spring 74 has a first tang 74*a* abutting a pin 56 extending rearward from the auxiliary ratchet 44 through an aperture 22*a* in the housing 22. The spring 74 has a second tang 74*b* that is coupled to the primary pawl 64 through another aperture 22*b* in the housing 22. As the biasing spring 74 is mounted to the auxiliary ratchet 44 rather than the fixed housing 22, the biasing forces on the primary pawl 64 will not vary appreciably as the auxiliary ratchet 44 rotates.

As seen in FIG. 1A, the ratchet 24 incorporates primary and secondary check shoulders 38 and 40 that interact with the check arm 68 of the primary pawl 64. Primary check shoulder 38 provides a fully closed and locked position of the ratchet 24 in which the striker is securely ensconced in the hook 30 of the ratchet 24 such that the vehicle door (not shown) is completely closed and door seals (not shown) are compressed. Secondary check shoulder 40 provides a partially closed and locked position of the ratchet 24 wherein the striker is loosely secured in the hook 30 of the ratchet 24 such that the vehicle door is locked but not completely closed against its seals.

As seen in FIG. 1B, the auxiliary ratchet 44 interfaces with a reset lever 76. The reset lever 76 is pivotally mounted for rotation about pin 46, and is biased to a single position as shown in FIG. 1B through the action of a spring 78 having two tangs that contact a nib 80 formed in the reset lever 76. The reset lever 76 has a fork 82 with two spaced apart prongs 82*a*, 82*b* that straddle the auxiliary ratchet pin 56 thus enabling the reset lever 76 to move the auxiliary ratchet 44 between the closed position (which may also be referred to as the enabling position) and the open position (which may also be referred to as the disabling position).

As seen in FIG. 1A an auxiliary pawl (which may be referred to as a secondary pawl 84) is also pivotally mounted in the housing 22 about a pin 86 for movement between a closed or auxiliary ratchet holding position where the secondary pawl 84 checks the opening movement of the auxiliary ratchet 44, as shown in FIG. 1A, and an open position (which may also be referred to as the auxiliary ratchet release position) as seen in FIG. 4. In the orientation shown in FIG. 1A the secondary pawl 84 will rotate clockwise to enter the open or auxiliary ratchet release position. The secondary pawl 84 features a hook shoulder 88 for engaging the auxiliary ratchet shoulder 54 to keep the auxiliary ratchet 44 in check.

In the illustrated embodiment the secondary pawl 84 is formed from front and rear levers 84*a* and 84*b*, the front lever being located in front of the housing 22 as shown in FIG. 1A and the rear lever being located behind the housing 22 as seen in FIG. 1B. The front and rear secondary pawl levers 84*a*, 84*b* are both mounted about pin 86 and move in unison as a result of a mortise and tenon connection at 90, the tenon moving in a slot 22*c* formed in the housing 22.

The front secondary pawl lever 84*a* has a bent tab 92 that projects through a slot 22*d* formed in the housing 22. This arrangement serves to delimit the angular sweep range of the secondary pawl 84.

As seen in FIG. 1B the rear secondary pawl lever 84*b* has a bent tab 94 extending rearward which is used to bias the secondary pawl 84 to the closed or auxiliary ratchet holding position by a spring 96 disposed about pin 86.

An electromechanical actuator 100 opens and resets the latch, as discussed in greater detail below. The actuator 100 includes an electric motor 102 nestled in a compartment formed in the housing 22. The motor 102 is controlled by an electronic controller (not shown) which may be contained in the latch 20 for applying power to the motor 102 to selectively drive the motor 102. The motor 102 drives a worm gear 104 which, in turn, drives a cam wheel 110 that is nestled in another compartment in the housing and is mounted for rotation about a post 106 provided therein. The cam wheel 110 has gear teeth 111 along the outer circumference thereof and is alternatively referred to herein as the "gear cam wheel".

Figure 2A:
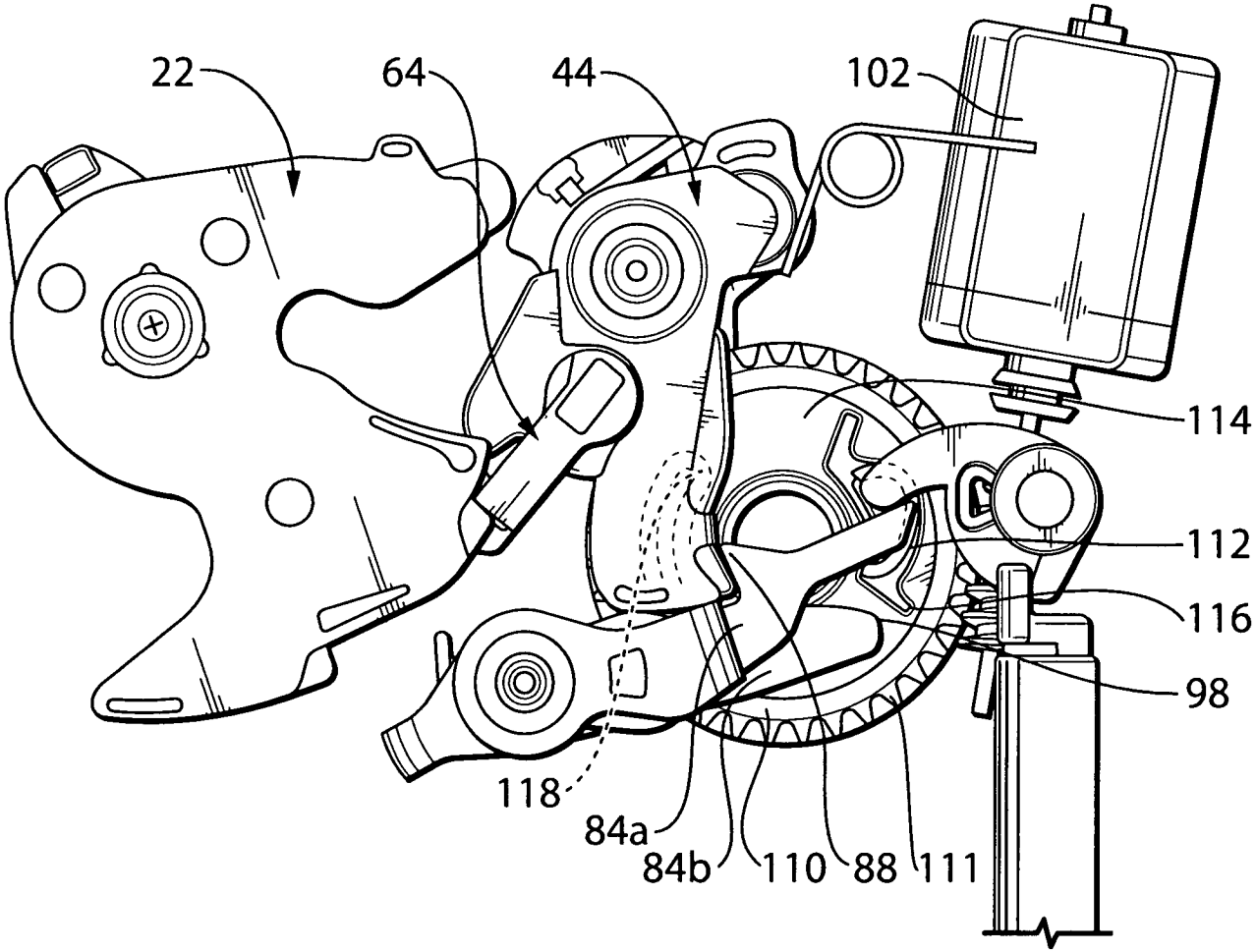
FIG. 2A is a front perspective view of an isolated portion of the latch, specifically of a gear cam wheel interacting with a variety of levers.
Figure 2B:
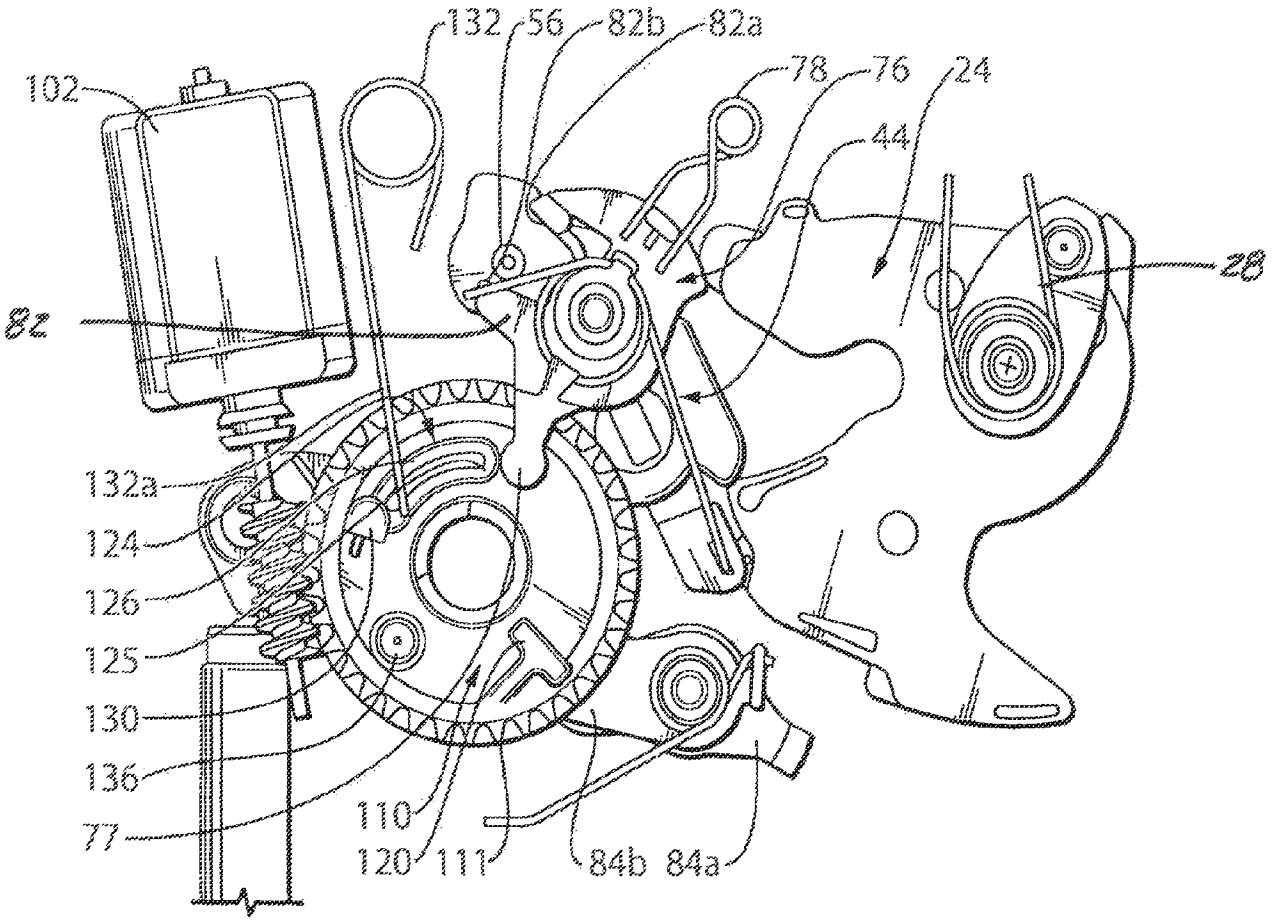
FIG. 2B is a rear perspective view of the isolated portion of the latch shown in FIG. 2A.

Referring additionally to the perspective views of FIGS. 2A and 2B, which show various parts of the latch 20 in isolation (and principally with the housing 22 removed from view), it will be seen that the gear cam wheel 110 interacts with the secondary pawl 84 and the reset lever 76.

Figure 3B:
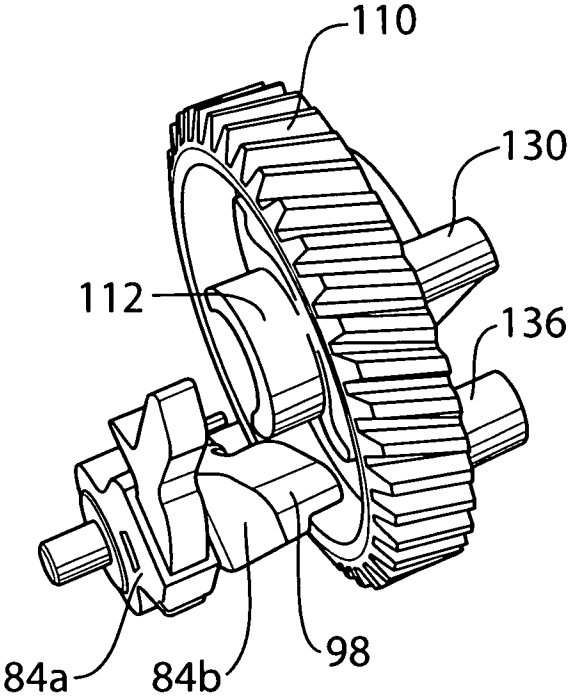
FIGS. 3A and 3B are isolated perspective views of the gear cam wheel and its relationship to one other lever from different viewpoints.
Figure 3A:
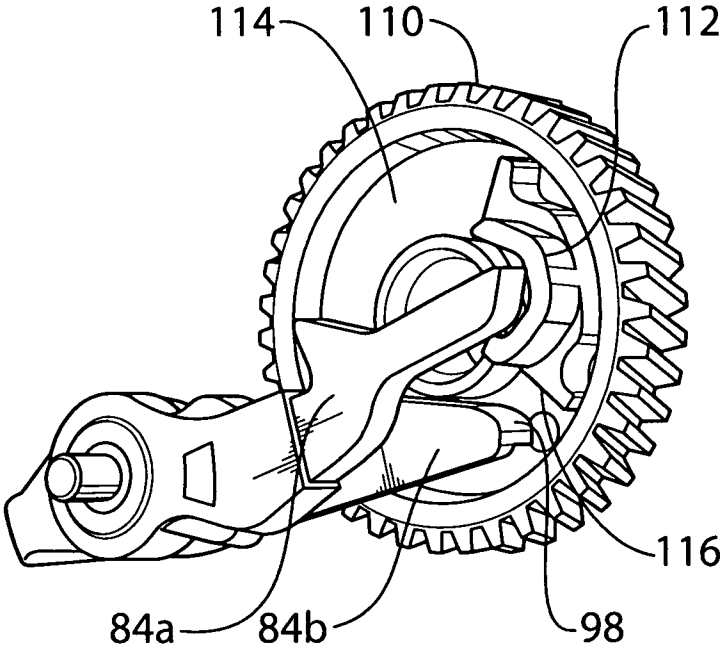

More particularly, as seen best in FIGS. 2A, 3A and 3B, the front side of the gear cam wheel 110 includes an integrally formed push block 112 that extends in an axial direction from a discus 114 of the gear cam wheel 110. The push block 112 engages an extended sidewall 98 of the rear secondary pawl lever 84*b* (see isolated views of FIG. 3). The gear cam wheel 110 also includes an integrally formed stop block 116 that extends in an axial direction from the discus 114 at a lower height than that of the push block 112. The stop block 116 interacts with a bumper 118 (see FIG. 2A) mounted in the housing.

As seen best in FIG. 2B, the opposing rear side of the gear cam wheel 110 features an integrally formed T-shaped push block 120 extending in an axial direction from the discus 114 that interacts with an arm 77 of the reset lever 76 (which may be referred to as the rest lever arm 77). Likewise, the gear cam wheel 110 features an arcuate push block 124 extending in an axial direction from the discus 114 that features a front edge 125 that interacts with the reset lever arm 77 and a tangential profile 126 that rides against the arm 77. The arcuate push block 124 terminates in a post 130. The post 130 interacts with a tang 132*a* of a cushioning spring 132 mounted about a fixed post 134 (FIG. 1B) formed in the housing 22. The cushioning spring 132 is one example of a type of elastic member that may be used herein.

In operation, to open the latch 20 from the fully closed position shown in FIG. 1A, the controller powers the actuator 100 to cause the gear cam wheel 110 to rotate (clockwise in FIG. 2A, counterclockwise in FIG. 2B). The gear push block 112 (FIG. 2A) first engages the extended sidewall 98 of the rear secondary pawl lever 84*b*, causing the secondary pawl 84 to move (the secondary pawl 84 pivots clockwise in FIG. 2A and counterclockwise in FIG. 2B) into its open or auxiliary ratchet release position as seen in FIG. 4. In the process, when the secondary pawl hook shoulder 88 clears or disengages from the auxiliary ratchet shoulder 54 the bias force on the auxiliary ratchet 44 and/or reaction to the reactionary force provided by the door seals as well known in the art will typically cause the auxiliary ratchet 44 to spring into its open or disabling position as shown in FIG. 4. And when the auxiliary ratchet 44 pivots into its open or disabling position, the auxiliary ratchet edge 70 carries the primary pawl 64 to its open or ratchet release position, following which the ratchet 24 springs into its open or striker release position, as shown in FIG. 4, due to the bias and reactionary seal forces thereon.

Figure 5:
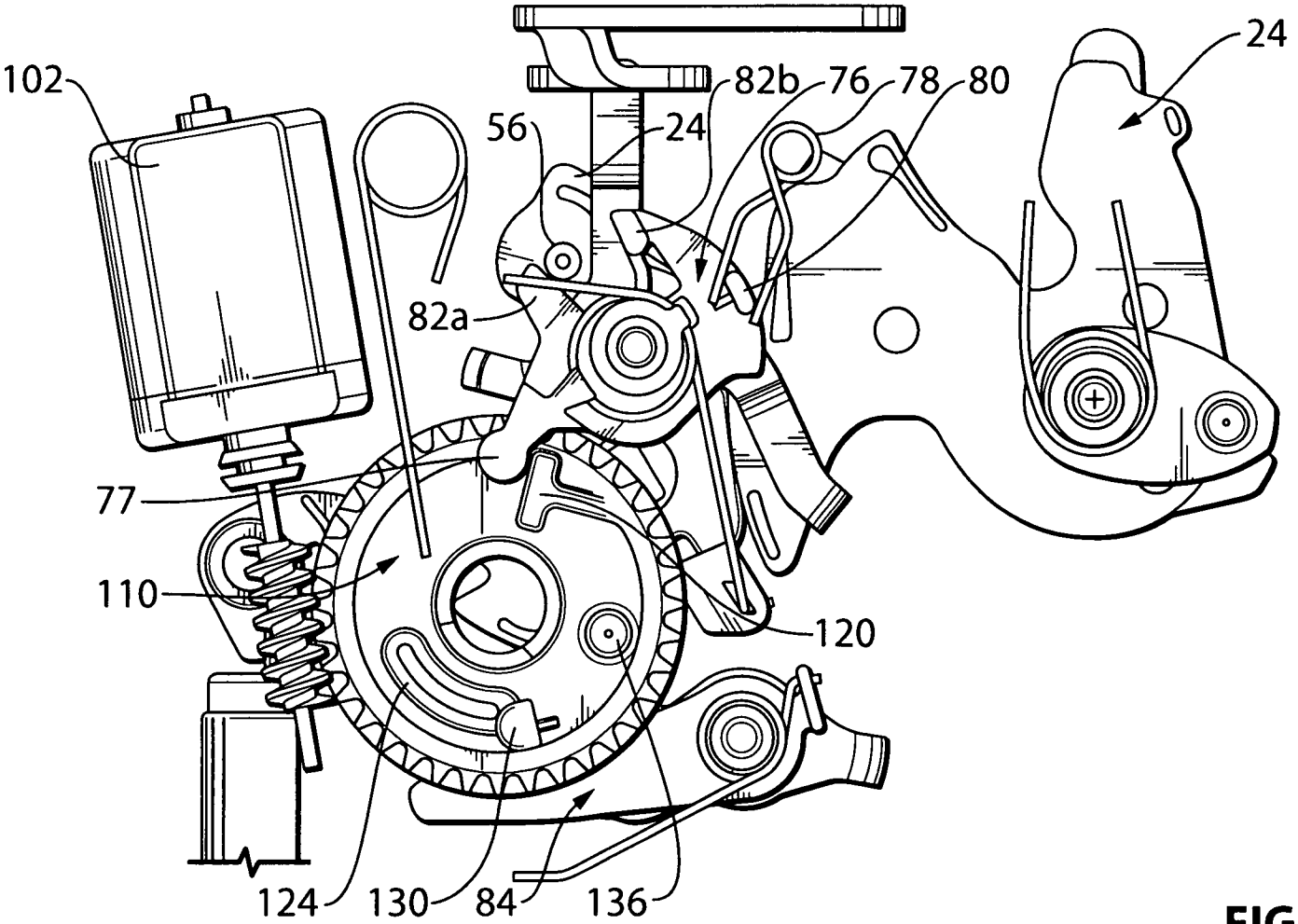
FIG. 5 is a partial rear elevation view of the latch in the partially actuated state shown in FIG. 4.

However, in the event the bias and/or seal force on the auxiliary ratchet 44 is insufficient, the gear cam wheel 110 can function to force the auxiliary ratchet 44 into its open or disabling position. More particularly as seen in FIG. 5, the controller continues to rotate the gear cam wheel 110 (counterclockwise in FIG. 5) until the T-shaped push block 120 engages the reset lever arm 77 of the reset lever 76 and moves it away from its biased position (the reset lever will rotate clockwise in FIG. 5). In the event the auxiliary ratchet 44 has not yet sprung into its open or disabling position, the auxiliary ratchet pin 56 will remain proximate to the reset lever fork prong 82*a* and thus moving the reset lever 76 will move the auxiliary ratchet 44 into its open or disabling position. In the event the auxiliary ratchet 44 has already sprung into its open or disabling position the auxiliary ratchet pin 56 will have moved proximate to the other reset lever fork prong 82*b* and thus moving the reset lever 76 will have no effect on the auxiliary ratchet 44 due to the "lost motion" connection between the pin 56 and the spaced apart prongs 82*a*, 82*b* of the reset lever 76.

At the this point in the motion of the gear cam wheel 110, the stop block 116 engages the bumper 118 (see FIG. 1B) mounted in the housing, preventing further rotation of the gear cam wheel 110. The controller senses an electrical current spike as a result of the gear cam wheel 110 hitting the hard limit, and stops rotating the gear cam wheel in its present direction. The limit may be signaled by additional or alternative other means including use of a limit switch (such as a "door open" switch, ratchet switch, handle switch), by or by reaching a specified time for applying power to the motor 102. An embodiment employs the current spike technique in conjunction with a timeout to avoid unnecessary power consumption, but however the limit is determined when it is reached the controller thereafter begins to rotate the gear cam wheel 110 in the opposite direction to begin a reset operation for the latch before the striker reenters the ratchet 24.

Figure 6:
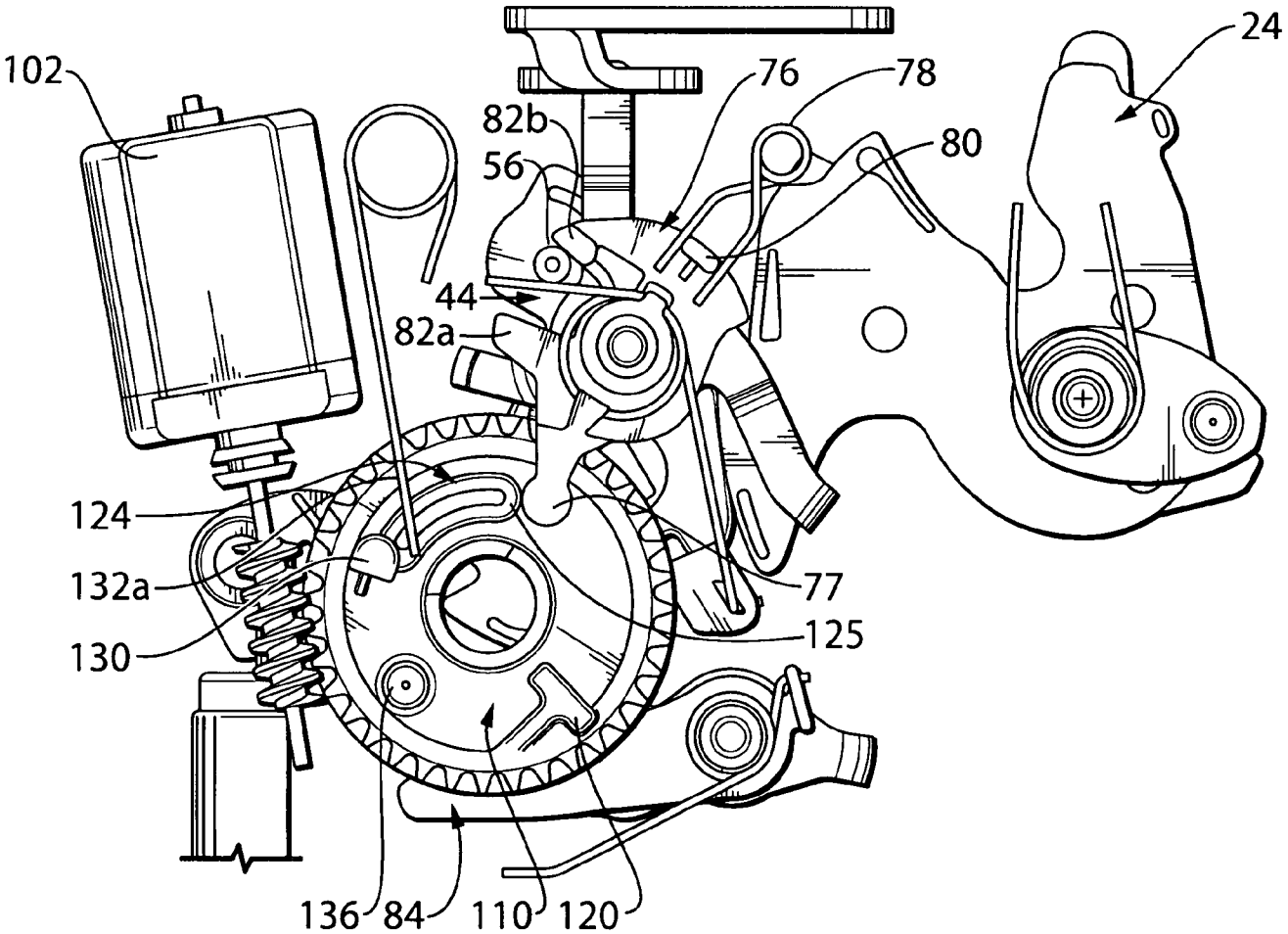
FIG. 6 is a partial rear elevation view of the latch in a first partially actuated state of re-setting the latch.

As the gear cam wheel 110 rotates in the opposite direction (clockwise in FIG. 5), the T-shaped stop block 120 retreats from the arm 77 of the reset lever 76, resulting in fork prong 82*b* moving proximate to the auxiliary ratchet pin 56 and the other fork prong 82*a* moving distal to the auxiliary ratchet pin 56, as seen in FIG. 6.

As seen in FIG. 6, as the gear cam wheel rotates in the opposite direction (clockwise in FIG. 6) for the reset operation, the leading edge 125 of the arcuate push block 124 will engage the arm 77 of the reset lever 76 and push the arm 77 away from its biased position (the reset lever will rotate counterclockwise in FIG. 6). This causes the fork prong 82*b* now proximate to the auxiliary ratchet pin 56 to begin to rotate the auxiliary ratchet 44 back to its closed or enabling position (as will be seen in FIG. 7). At this point in FIG. 6, the gear cam wheel push block 112 keeps the secondary pawl 84 in its open or auxiliary ratchet releasing position.

Figure 7:
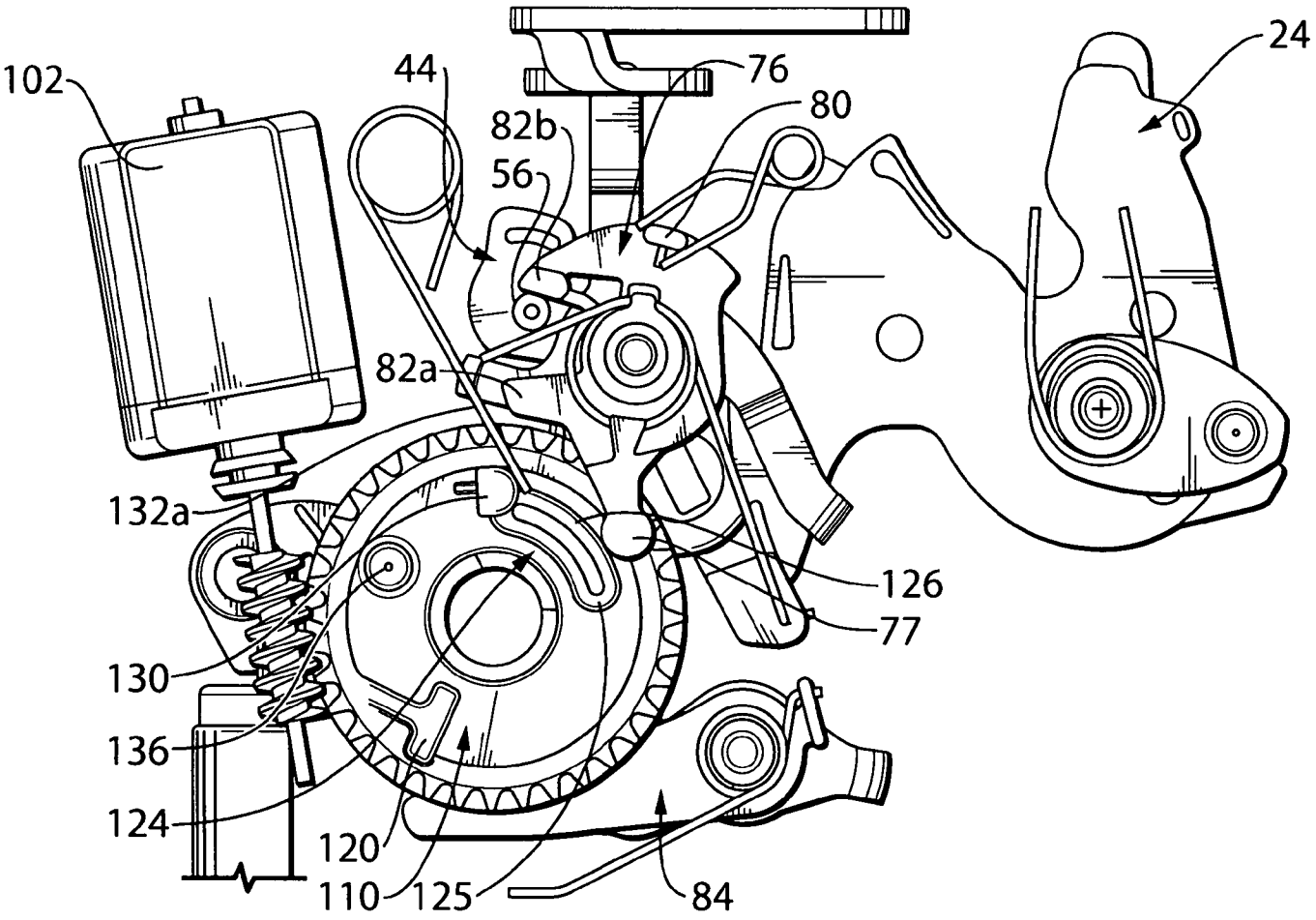
FIG. 7 is a partial rear elevation view of the latch in a second partially actuated state of re-setting the latch.

FIG. 7 shows the auxiliary ratchet 44 as it has just been moved back into its closed or enabled position, and the secondary pawl 84 (which had been kept open as a result of a hook shoulder 88 abutting against the cushioning surface 52 of the open auxiliary ratchet) is about to spring back into its closed or auxiliary ratchet holding position. However, the gear cam wheel 110 does not come to a hard stop after moving the arm 77 of the reset lever 76. Instead, the tangential profile 126 of the arcuate push block 124 is disposed at a radius that enables the arcuate push block 124 to continue to rotate in what is essentially an over-travel condition so that the arm 77 rides against the tangential profile 126. Hence, it will be appreciated that the leading edge 125 of the arcuate push block 124 thus kinematically couples the gear cam wheel 110 to the reset lever 76 because the leading edge 125 has the effect of moving the reset lever 76 to a different position, whereas the tangential profile 126 kinematically decouples the gear cam wheel 110 from the reset lever 76 because that profile does not move the reset lever to a different position.

As the gear cam wheel 110 rotates the post 130 of the arcuate push block 124 comes into contact with the tang 132*a* of the cushioning spring 132 which absorbs the kinetic energy of the motor 102 and gear cam wheel 110. The arc length of the tangential profile 126 is set to ensure that the gear cam wheel 110 will have enough free travel to be decelerated once the auxiliary ratchet 44 has been reset. In this manner the gear cam wheel decelerates without hitting a hard stop, minimizing noise on reset.

In addition, the gear cam wheel 110 may also carry a magnetic element 136 which triggers a Hall effect sensor 140 (see FIG. 1B) connected to a printed circuit board (not shown) overlaid with a cover (not shown) of the latch. The controller uses the output of the Hall effect sensor 140 to switch off power to the motor 102, putting it in a short circuit condition so as to add a dynamic braking effect. The Hall effect sensor 140 and magnetic element 136 are disposed so that the power is switched off as the post 130 begins to load the cushioning spring 132.

Figure 8:
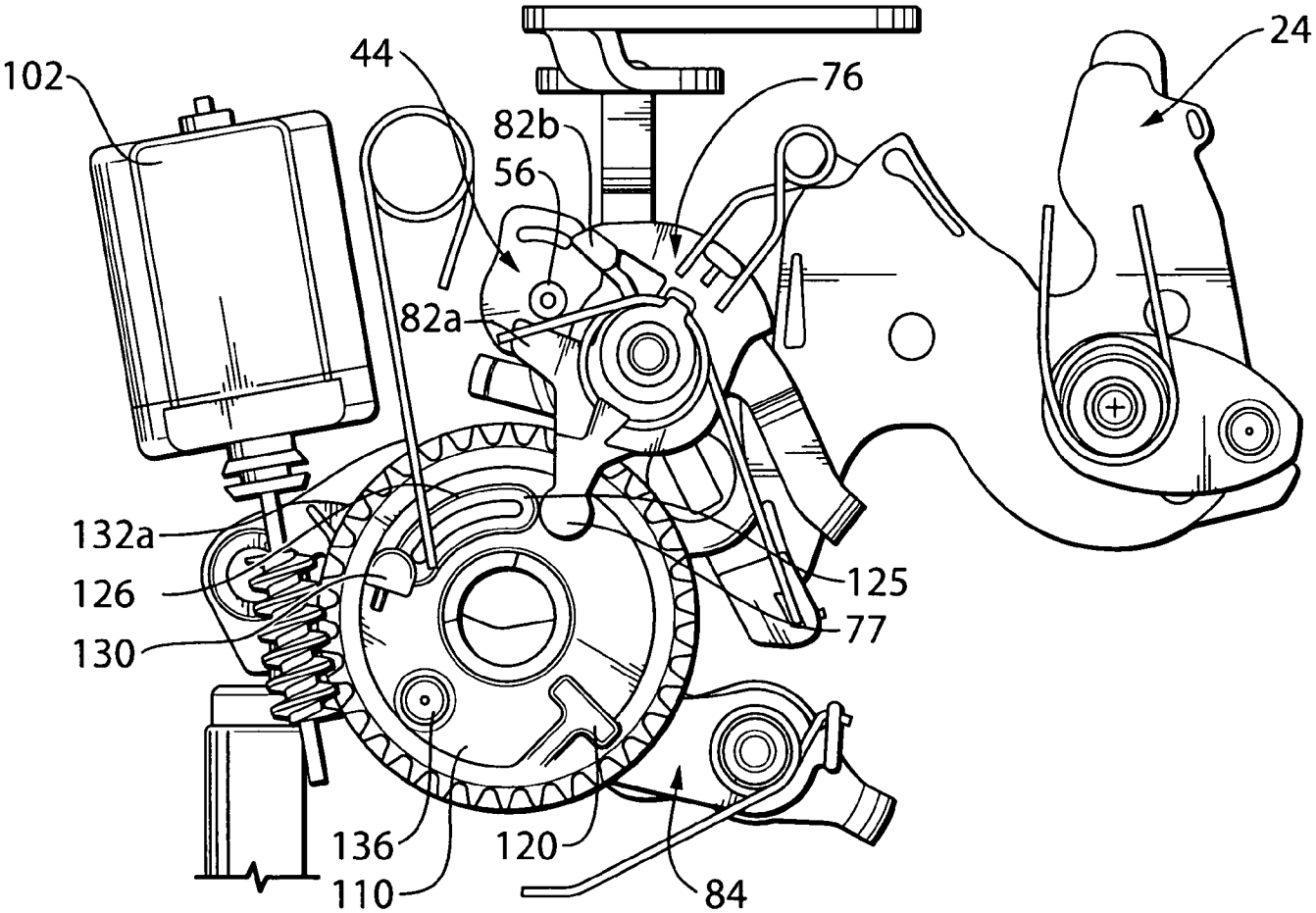
FIG. 8 is a partial rear elevation view of the latch in a reset condition.
Figure 9:
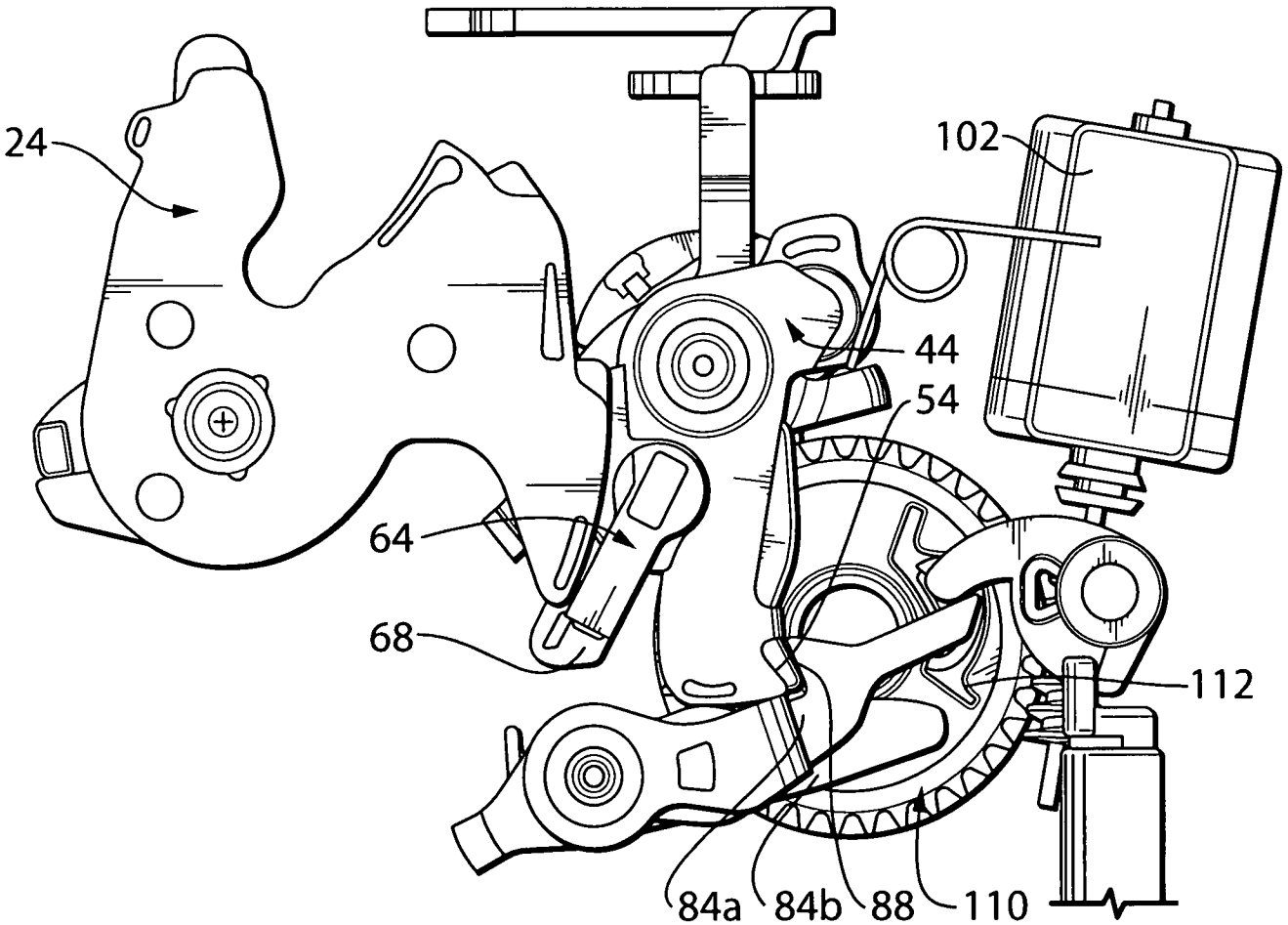
FIG. 9 is a partial front elevation view of the latch in the reset condition.

Once loaded, the cushioning spring 132 then unloads and consequently repositions the gear cam wheel 110 back to its initial position, as shown in the rear and front views of FIGS. 8 and 9 respectively. The latch 20 is now in a reset condition where, as seen best in FIG. 9, the auxiliary ratchet 44 is positioned in the closed position and the secondary pawl 84 is positioned in the closed position. However, the primary pawl 64 is not yet in the closed position since the check arm 68 merely brushes up against an open ratchet 24. Only when the vehicle is door is closed and the striker reenters the ratchet hook 30 will the ratchet 24 rotate to the closed or striker retaining portion, enabling the bias force present on the primary pawl 64 to move the check arm 68 into blocking position against the ratchet primary shoulder 38 as shown in FIG. 1A (or secondary shoulder 40 in the event of a weakly closed door.)

The sequence of resetting the latch immediately upon opening has benefits in that in the process of later closing the latch the only moving parts are the ratchet 34 and primary pawl 64, the movements of which have relatively low noise. More importantly, there is no need to synchronize the movement any parts upon closing the latch which could occur very quickly or slowly depending on how fast the vehicle door is closed. The latch is thus not speed sensitive, and thus it is possible to avoid such problems in resetting the latch during closing.

The illustrated embodiment also features two manual mechanisms for opening the latch in case of emergency (or where such features are desirable for everyday use in a hybrid electrical/manual latch). As seen in FIG. 1A, a key cylinder 160 can rotate an intermediate lever 162 which interacts with an arm 164 of the front secondary pawl lever 84*a* to manually release the secondary pawl 84 to the open position, allowing the latch to open due to the bias and seal forces discussed above.

Figure 10:
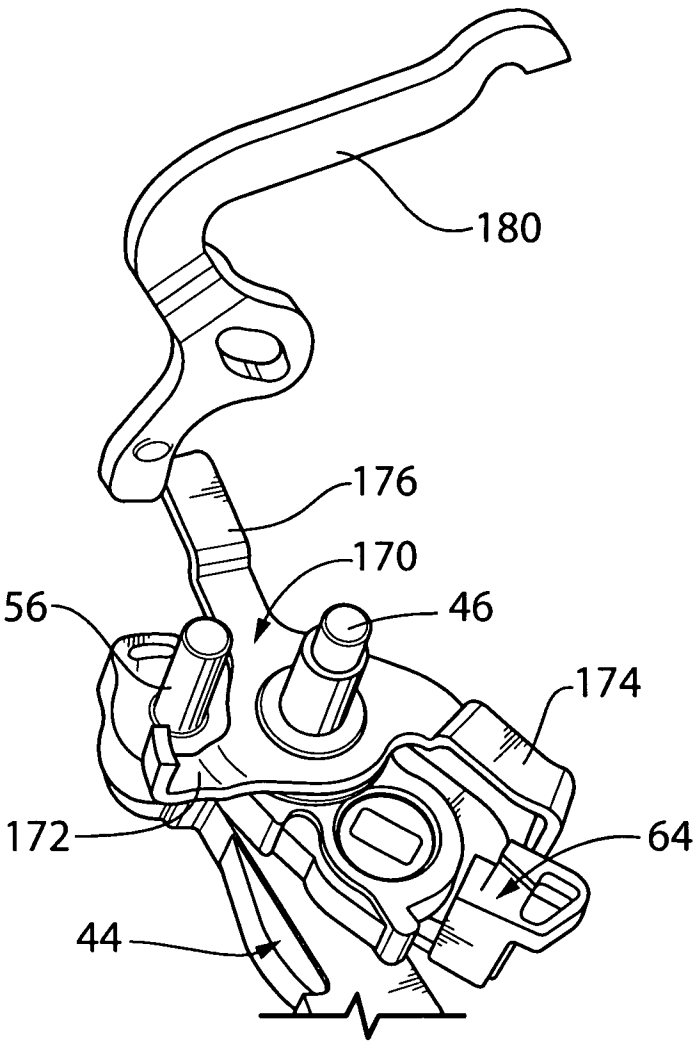
FIG. 10 is an isolated perspective view of an emergency release lever in relationship to select other levers.

In addition, in the event the bias and seal forces are insufficient to move the auxiliary ratchet 44 to its open or disabling position, as seen in FIG. 1B an intermediate emergency release lever 170 having three limbs 172, 174, 176 is rotationally mounted about pin 46. Referring additionally to the isolated view of FIG. 10, limb 172 engages and actuates the auxiliary ratchet 44 into its open or disabled position and limb 174 engages and actuates the primary pawl 64 into its open or ratchet release position. The third limb 176 engages a release lever 180 that may be connected, for example, to a door handle, and provides the manual input. A spring 178 biases the intermediate emergency release lever 170 to the non-actuated position.

From the foregoing, it will be seen that a latch in accordance with an embodiment of the invention, has (i) eliminated a hard stop in the gear train by increasing the rotational travel of the gear cam wheel whilst decoupling the gear train from the levers responsible for resetting the latch; (ii) used a cushioning spring instead of a hard stop to absorb motor energy and decelerate the gear cam wheel; and (iii) utilized a sensor to switch off the motor before reaching the gear full travel. In alternative embodiments, one or more of these techniques may optionally be used.

Those skilled in the art will appreciate that while the illustrated embodiment has introduced a reset lever as an intermediary lever between the gear cam wheel and the auxiliary ratchet, in alternative embodiment a gear cam wheel and its associated drive mechanism may act directly on an auxiliary ratchet which has a direct interface with the gear cam wheel such as shown and described in Applicant's co-pending application PCT/CA2010/001890 filed Nov. 26, 2010 and entitled "Vehicular Latch with Double Pawl Arrangement". Similarly, while the gear cam wheel has been shown in an embodiment as being circular and driven by a worm gear and motor, other configurations are possible in alternative embodiments such as a sector gear or an eccentric gear driven by a worm or other gear train. Likewise, while a magnetic element and Hall effect sensor are provided in an embodiment to signal the position of the gear cam wheel other techniques well known in the art can be employed in the alternative such as limit switches, electrical contacts, wire traces or a timeouts (power being applied for a minimum and/or maximum length of time, from which the position of the gear cam wheel is deduced).

While the above description constitutes a plurality of embodiments of the present invention, it will be appreciated that the present invention is susceptible to further modification and change without departing from the fair meaning of the accompanying claims.

The invention claimed is:

1. A vehicle latch, comprising:

a ratchet movable between a striker release position wherein the ratchet is positioned to receive a striker and a striker capture position wherein the ratchet is positioned to retain the striker, the ratchet being biased towards the striker release position;

a primary pawl movable between a ratchet checking position wherein the primary pawl is positioned to keep the ratchet in the striker capture position and a ratchet release position wherein the primary pawl permits the movement of the ratchet out of the striker capture position, wherein the primary pawl is biased towards the ratchet checking position;

an auxiliary ratchet pivotably supporting the primary pawl, wherein the auxiliary ratchet is movable between an enabling position in which the primary pawl is enabled to move to the ratchet checking position and a disabling position in which the auxiliary ratchet positions the primary pawl to the ratchet release position, wherein the auxiliary ratchet is biased toward the disabling position;

a secondary pawl movable between an auxiliary ratchet holding position in which the secondary pawl is positioned to hold the auxiliary ratchet in the enabling position, and an auxiliary ratchet release position in which the secondary pawl is positioned to permit movement of the auxiliary ratchet to the disabling position, the secondary pawl being biased to the auxiliary ratchet holding position;

an elastic member; and a drive mechanism including a motor driving a cam via a gear set, the cam being operatively connected to the auxiliary ratchet and the secondary pawl, the cam moving in a first direction to place the vehicle latch in an open state by moving the secondary pawl into the auxiliary ratchet release position, the auxiliary ratchet thereafter moving to the disabling position such that the primary pawl is moved to the ratchet release position for releasing the ratchet and allowing the ratchet to move to the striker release position, and the cam moving in a second direction to place the vehicle latch in a reset state by moving the auxiliary ratchet into the enabling position, the secondary pawl thereafter moving to the auxiliary ratchet holding position while the ratchet remains in the striker release position, wherein the cam, when moving in the first direction also actuates the auxiliary ratchet to the disabling position in the event that the auxiliary ratchet does not enter the disabling position upon movement of the secondary pawl out of the auxiliary ratchet holding position for moving the primary pawl into the ratchet release position, and wherein the cam, after moving the auxiliary ratchet to the enabling position, continues to travel in the second direction to load the elastic member for decelerating the cam.

2. The vehicle latch as claimed in claim 1 further including a controller and a signaling means for signaling to the controller when the cam loads the elastic member, the controller being operative to switch off power to the motor in response to the signaling means.

3. The vehicle latch as claimed in claim 1 further including a reset lever operatively connected between the cam and the auxiliary ratchet, wherein, when moving in the first direction, the cam actuates the reset lever which in turn actuates the auxiliary ratchet in the event the auxiliary ratchet has not yet entered into the disabling position, and when moving in the second direction, the cam actuates the reset lever which in turn actuates the auxiliary ratchet.

4. The vehicle latch as claimed in claim 3, wherein the auxiliary ratchet has a projection and the reset lever has a fork with spaced apart first and second prongs straddling the projection, the reset lever being biased to an initial position where the first prong is proximate the projection and the second prong is distal the projection, wherein movement of the cam in the first direction to actuate the reset lever causes the first prong to move the projection, wherein initial movement of the cam in the second direction causes the reset lever to return to the initial position such that the second prong is proximate the projection and the first prong is distal the projection, and wherein continued movement of the cam in the second direction to actuate the reset lever causes the second prong to move the projection.

5. The vehicle latch as claimed in claim 3 wherein the cam is a gear wheel having a discus and a circumference with gear teeth disposed along the circumference, wherein a first push block is disposed on the discus for engaging the secondary pawl, wherein a second push block is disposed on the discus for engaging the reset lever in the first direction of motion, and wherein an arcuate push block is disposed on the discus for engaging the reset lever in the second direction of motion, the arcuate push block having a post for loading the elastic member.

6. The vehicle latch as claimed in claim 1 wherein the auxiliary ratchet is pivotal about a first axis, and wherein the primary pawl is pivotally mounted to the auxiliary ratchet about a second axis that is offset from the first axis.

7. The vehicle latch as claimed in claim 1 including means for manually actuating the secondary pawl to the auxiliary ratchet release position.

8. The vehicle latch as claimed in claim 7 wherein the means for manually actuating the secondary pawl to the auxiliary ratchet release position includes a manually actuated emergency release lever having a first limb for engaging the auxiliary ratchet and a second limb for engaging the primary pawl.

9. The vehicle latch as claimed in claim 8 wherein the emergency release lever is actuated by a door handle.

10. A vehicle latch, comprising:

a ratchet movable between a striker release position wherein the ratchet is positioned to receive a striker and a striker capture position wherein the ratchet is positioned to retain the striker, the ratchet being biased towards the striker release position;

a primary pawl movable between a ratchet checking position wherein the primary pawl is positioned to keep the ratchet in the striker capture position and a ratchet release position wherein the primary pawl permits the movement of the ratchet out of the striker capture position, wherein the primary pawl is biased towards the ratchet checking position;

an auxiliary ratchet operatively connected to the primary pawl, wherein the auxiliary ratchet is movable between an enabling position in which the primary pawl is enabled to move to the ratchet checking position and a disabling position in which the auxiliary ratchet positions the primary pawl to the ratchet release position, the auxiliary ratchet being biased to the disabling position;

a secondary pawl movable between an auxiliary ratchet holding position in which the secondary pawl is positioned to hold the auxiliary ratchet in the enabling position, and an auxiliary ratchet release position in which the secondary pawl is positioned to permit movement of the auxiliary ratchet to the disabling position, the secondary pawl being biased to the auxiliary ratchet holding position;

an elastic member;

a drive mechanism including a motor driving a cam via a gear set, the cam being operatively connected to the auxiliary ratchet and the secondary pawl, the cam moving in a first direction to place the vehicle latch in an open state by moving the secondary pawl into the auxiliary ratchet release position, the auxiliary ratchet thereafter moving to the disabling position such that the primary pawl is moved to the ratchet release position for releasing the ratchet and allowing the ratchet to move to the striker release position, and the cam moving in a second direction to place the vehicle latch in a reset state by moving the auxiliary ratchet into the enabling position, the secondary pawl thereafter moving to the auxiliary ratchet holding position while the ratchet remains in the striker release position; and a reset lever operatively connected between the cam and the auxiliary ratchet;

wherein the cam, after moving the auxiliary ratchet to the enabling position, continues to travel in the second direction to load the elastic member which decelerates the cam, wherein movement of the cam in the first direction actuates the auxiliary ratchet to the disabling position in the event the auxiliary ratchet does not enter the disabling position upon movement of the secondary pawl out of the auxiliary ratchet holding position so as to move the primary pawl into the ratchet release position, and wherein movement of the cam in the first direction also causes the cam to actuate the reset lever which in turn actuates the auxiliary ratchet in the event the auxiliary ratchet has not yet entered the disabling position, and movement of the cam in the second direction causes the cam to actuate the reset lever which in turn actuates the auxiliary ratchet.

11. The vehicle latch as claimed in claim 10 further including a controller and a signaling means for signaling to the controller when the cam loads the elastic member, the controller being operative to switch off power to the motor in response to the signaling means.

12. The vehicle latch as claimed in claim 10 wherein the auxiliary ratchet has a projection and the reset lever has a fork with two spaced apart first and second prongs straddling the projection, the reset lever being biased to an initial position where the first prong is proximate the projection and the second prong is distal the projection, wherein movement of the cam in the first direction to actuate the reset lever causes the first prong to move the projection, wherein the initial movement of the cam in the second direction causes the reset lever to return to the initial position such that the second prong is proximate the projection and the first prong is distal the projection, and wherein continued movement of the cam in the second direction to actuate the reset lever causes the second prong to move the projection.

13. The vehicle latch as claimed in claim 12 wherein the cam is a gear wheel having a discus and a circumference having gear teeth, wherein a first push block is disposed on the discus for engaging the secondary pawl, wherein a second push block is disposed on the discus for engaging the reset lever in the first direction of motion, and wherein an arcuate push block is disposed on the discus for engaging the reset lever in the second direction of motion, the arcuate push block having a post for loading the elastic member.

14. The vehicle latch as claimed in claim 10 wherein the primary pawl is pivotally mounted to the auxiliary ratchet.

15. The vehicle latch as claimed in claim 14 wherein the auxiliary ratchet is pivotal about a first axis, and wherein the primary pawl is pivotally mounted to the auxiliary ratchet about a second axis that is offset from the first axis.

16. The vehicle latch as claimed in claim 10 including means for manually actuating the secondary pawl to the auxiliary ratchet release position.

17. The vehicle latch as claimed in claim 16 wherein the means for manually actuating the secondary pawl to the auxiliary ratchet release position includes a manually actuated emergency release lever having a first limb for engaging the auxiliary ratchet and a second limb for engaging the primary pawl.

18. The vehicle latch as claimed in claim 17 wherein the emergency release lever is actuated by a door handle.

19. A vehicle latch, comprising:

a ratchet movable between a striker release position wherein the ratchet is positioned to receive a striker and a striker capture position wherein the ratchet is positioned to retain the striker, the ratchet being biased towards the striker release position;

a primary pawl movable between a ratchet checking position wherein the primary pawl is positioned to keep the ratchet in the striker capture position and a ratchet release position wherein the primary pawl permits the movement of the ratchet out of the striker capture position, wherein the primary pawl is biased towards the ratchet checking position;

an auxiliary ratchet operatively connected to the primary pawl, wherein the auxiliary ratchet is movable between an enabling position in which the primary pawl is enabled to move to the ratchet checking position and a disabling position in which the auxiliary ratchet positions the primary pawl to the ratchet release position;

a secondary pawl movable between an auxiliary ratchet holding position, in which the secondary pawl is positioned to hold the auxiliary ratchet in the enabling position, and an auxiliary ratchet release position, in which the secondary pawl is positioned to permit movement of the auxiliary ratchet to the disabling position, the secondary pawl being biased to the auxiliary ratchet holding position;

an elastic member;

a drive mechanism including a motor driving a cam via a gear set, the cam being operatively connected to the auxiliary ratchet and the secondary pawl, the cam moving in a first direction to place the vehicle latch in an open state by moving the secondary pawl into the auxiliary ratchet release position, the auxiliary ratchet thereafter moving to the disabling position such that the primary pawl is moved to the ratchet release position for releasing the ratchet and allowing the ratchet to move to the striker release position, and the cam moving in a second direction to place the vehicle latch in a reset state by moving the auxiliary ratchet into the enabling position, the secondary pawl thereafter moving to the auxiliary ratchet holding position while the ratchet remains in the striker release position; and means for manually actuating the secondary pawl to the auxiliary ratchet release position, the means for manually actuating the secondary pawl to the auxiliary ratchet release position including a manually actuated emergency release lever having a first segment for engaging the auxiliary ratchet and second segment for engaging the primary pawl;

wherein the cam, after moving the auxiliary ratchet to the enabling position, continues to travel in the second direction to load the elastic member which decelerates the cam.

20. The vehicle latch as claimed in claim 19 wherein the emergency release lever is actuated by a door handle.

21. The vehicle latch as claimed in claim 19 further including a controller and a signaling means for signaling the controller when the cam loads the elastic member, the controller being operative to switch off power to the motor in response to the signaling means.

22. The vehicle latch as claimed in claim 19 wherein the auxiliary ratchet is biased to the disabling position and wherein the cam, when moving in the first direction, also actuates the auxiliary ratchet to the disabling position in the event the auxiliary ratchet does not enter the disabling position upon movement of the secondary pawl out of the auxiliary ratchet holding position, whereby the primary pawl is moved into the ratchet release position.

23. The vehicle latch as claimed in claim 19 further including a reset lever operatively connected between the cam and the auxiliary ratchet, wherein, when moving in the first direction, the cam actuates the reset lever which in turn actuates the auxiliary ratchet in the event the auxiliary ratchet has not yet entered into the disabling position, and when moving in the second direction, the cam actuates the reset lever which in turn actuates the auxiliary ratchet.

* * * * *